US011015894B1

(12) United States Patent
Malina

(10) Patent No.: US 11,015,894 B1
(45) Date of Patent: May 25, 2021

(54) TRIGGER RESISTANCE SETTING MECHANISM

(71) Applicant: CESKA ZBROJOVKA A.S., Uhersky Brod (CZ)

(72) Inventor: Jaroslav Malina, Uherske Hradiste (CZ)

(73) Assignee: CESKA ZBROJOVKA A.S., Uhersky Brod (CZ)

( * ) Notice: Subject to any disclaimer, the term of this patent is extended or adjusted under 35 U.S.C. 154(b) by 0 days.

(21) Appl. No.: 17/093,348

(22) Filed: Nov. 9, 2020

(30) Foreign Application Priority Data

Dec. 6, 2019 (CZ) ..... CZ2019-748

(51) Int. Cl.
*F41A 19/16* (2006.01)

(52) U.S. Cl.
CPC ..... *F41A 19/16* (2013.01)

(58) Field of Classification Search
CPC ..... F41A 19/16; F41A 19/17
USPC ..... 42/69.01, 69.03
See application file for complete search history.

(56) References Cited

U.S. PATENT DOCUMENTS 6,880,281 B1 * 4/2005 Orr ..... F41A 17/46 42/69.01
8,250,799 B2 * 8/2012 Duperry ..... F41A 19/16 42/70.04
2009/0113777 A1 5/2009 Williams et al.

FOREIGN PATENT DOCUMENTS

DE 2926559 A1 * 1/1981 ..... F41A 19/16
EP 0165334 B1 * 4/1988 ..... F41A 17/56

* cited by examiner

*Primary Examiner* — Reginald S Tillman, Jr.
(74) *Attorney, Agent, or Firm* — Hovey Williams LLP

(57) ABSTRACT

A trigger resistance mechanism, especially of rifles, comprising a trigger device, containing at least one class 1 lever (12) whose one arm is adapted to be controlled by the trigger (2) while a trigger (2) resistance spring (4) bears on the other arm. The spring (4) is fitted, at the end averted from the trigger (2), with a bearing element (3) that bears on a cam (1) that is seated in the firearm frame in a rotary way.

7 Claims, 5 Drawing Sheets

TRIGGER RESISTANCE SETTING MECHANISM

RELATED APPLICATION

This non-provisional patent application claims the priority benefit of Czech Patent Application Serial No. PV2019-748 entitled "Trigger Resistance Setting Mechanism," filed Dec. 6, 2019, the entire disclosure of which is incorporated herein by reference.

TECHNICAL FIELD

The invention relates to a trigger resistance setting mechanism, especially of rifles, comprising a trigger device containing at least one class 1 lever whose one arm is adapted to be controlled by the trigger while the trigger resistance spring bears on its other arm.

BACKGROUND

Trigger resistance refers to the amount of force that needs to be exerted on the trigger to push it a consequently cause a shot.

Conventional methods generally use a screw to set the trigger resistance wherein the screw compresses or releases a spring acting directly on the trigger. In hunting weapons, these screws are mostly hidden inside the weapon, so to set the trigger resistance, the stock must be removed. In sports weapons, these screws are generally situated around the trigger. A disadvantage of these solutions is also the impossibility to control the actual trigger resistance value. If a screw gets excessively released, there is also a risk that it may fall out and get lost.

The document US2009113777 discloses a trigger assembly comprising a trigger and a return spring plunger with a return spring wherein this assembly allows the user to reduce the pressure exerted on the trigger required for shooting from a firearm by allowing him to retract the return spring plunger to return it to its initial position, namely by inserting a lever that exerts force on the return spring plunger to move it away from the trigger. A disadvantage of such a solution is its structural complexity.

The object of the invention is to propose such a trigger resistance setting mechanism that would not exhibit the above-mentioned drawbacks of the prior art.

SUMMARY

The said object is achieved through a trigger resistance mechanism, especially of rifles, comprising a trigger device, containing at least one class 1 lever whose one arm is adapted to be controlled by the trigger while a trigger resistance spring bears on the other arm, according to the invention the principle of which is that the spring is fitted, at the end averted from the trigger, with a bearing element that bears on a cam that is seated in the firearm frame in a rotary way.

An advantage of the mechanism according to the invention is quick and precise setting of the trigger resistance value. A change of the setting is simple and does not require any further handling of the weapon, e.g. removing the stock. The design of the mechanism allows the user to easily check the set value any time.

In a preferred embodiment, the cam has recesses with a variable depth arranged along its perimeter for engagement of the bearing element.

In another preferred embodiment, the cam is arranged on a shaft wherein the shaft is seated in a bushing in a rotary manner while the bushing is seated in the firearm frame.

To compensate production tolerances, the bushing is preferably seated in the firearm frame adjustably in the spring axis direction, e.g. the bushing may be seated in the firearm frame in a swiveling way on a transversal pin in such a way that the cam is adjustable in the spring axis direction, and a setscrew may bear on the bushing to move the bushing with the cam in the spring axis direction.

To enable easy changing or checking of the set trigger resistance value, the shaft is preferably freely accessible in the firearm frame at its end averted from cam and is equipped with a shaped opening for engagement of a setting tool.

BRIEF DESCRIPTION OF DRAWINGS

The invention will be clarified in more detail with reference to particular embodiments of the trigger resistance setting mechanism according to the invention, illustrated in the attached drawings wherein individual figures show.

DETAILED DESCRIPTION

Figure 1:
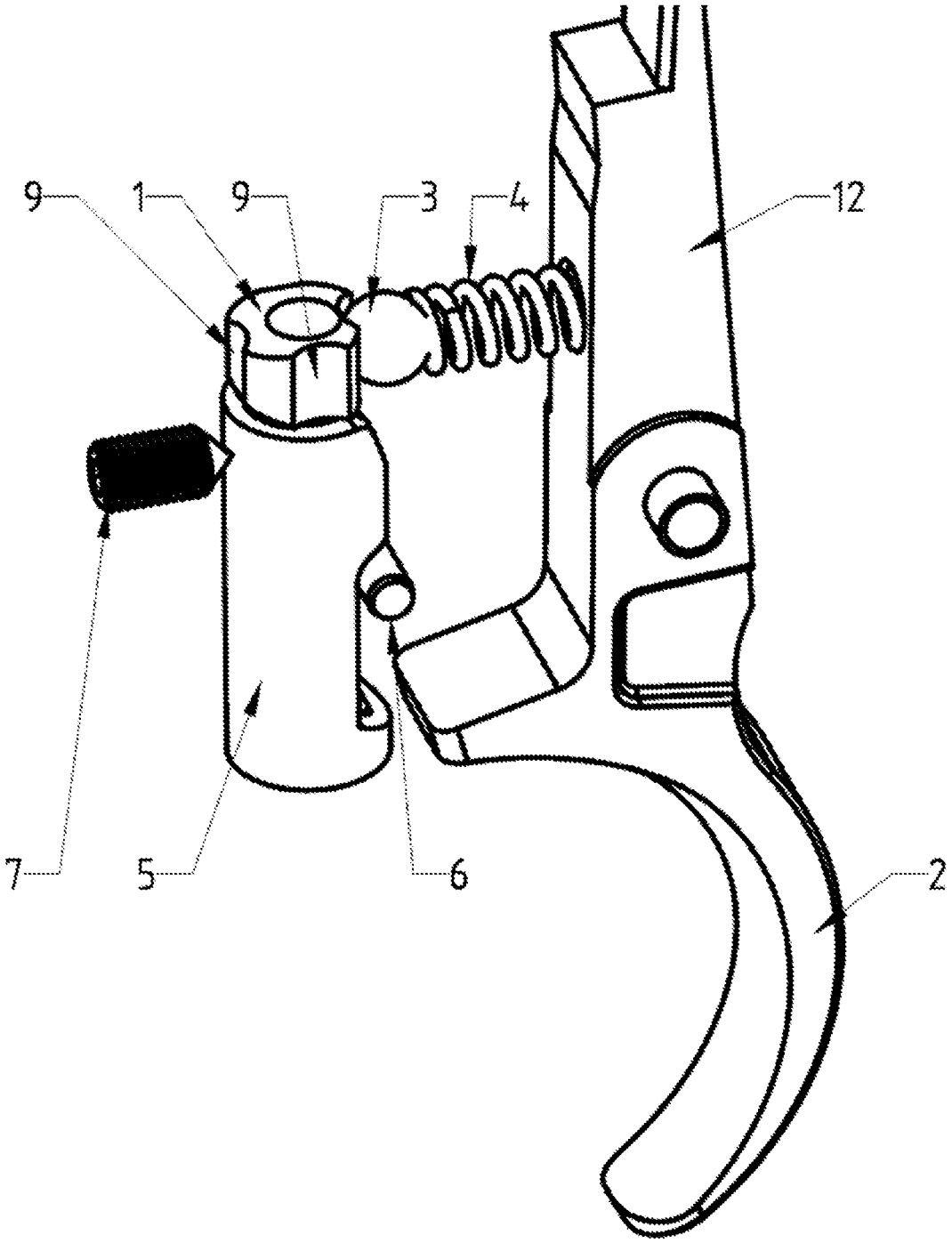
FIG. 1—the first embodiment example of the trigger resistance setting mechanism according to the invention in an axonometric view FIG. 2—a cross-section of the mechanism of FIG. 1, incorporated in a firearm, in a lateral view FIG. 3—a cross-section of the mechanism of FIG. 1, incorporated in a firearm, in a top view FIG. 4—a view of the setting part of the mechanism according to the invention FIG. 5—the second embodiment example of the trigger resistance setting mechanism according to the invention in an axonometric view
Figure 2:
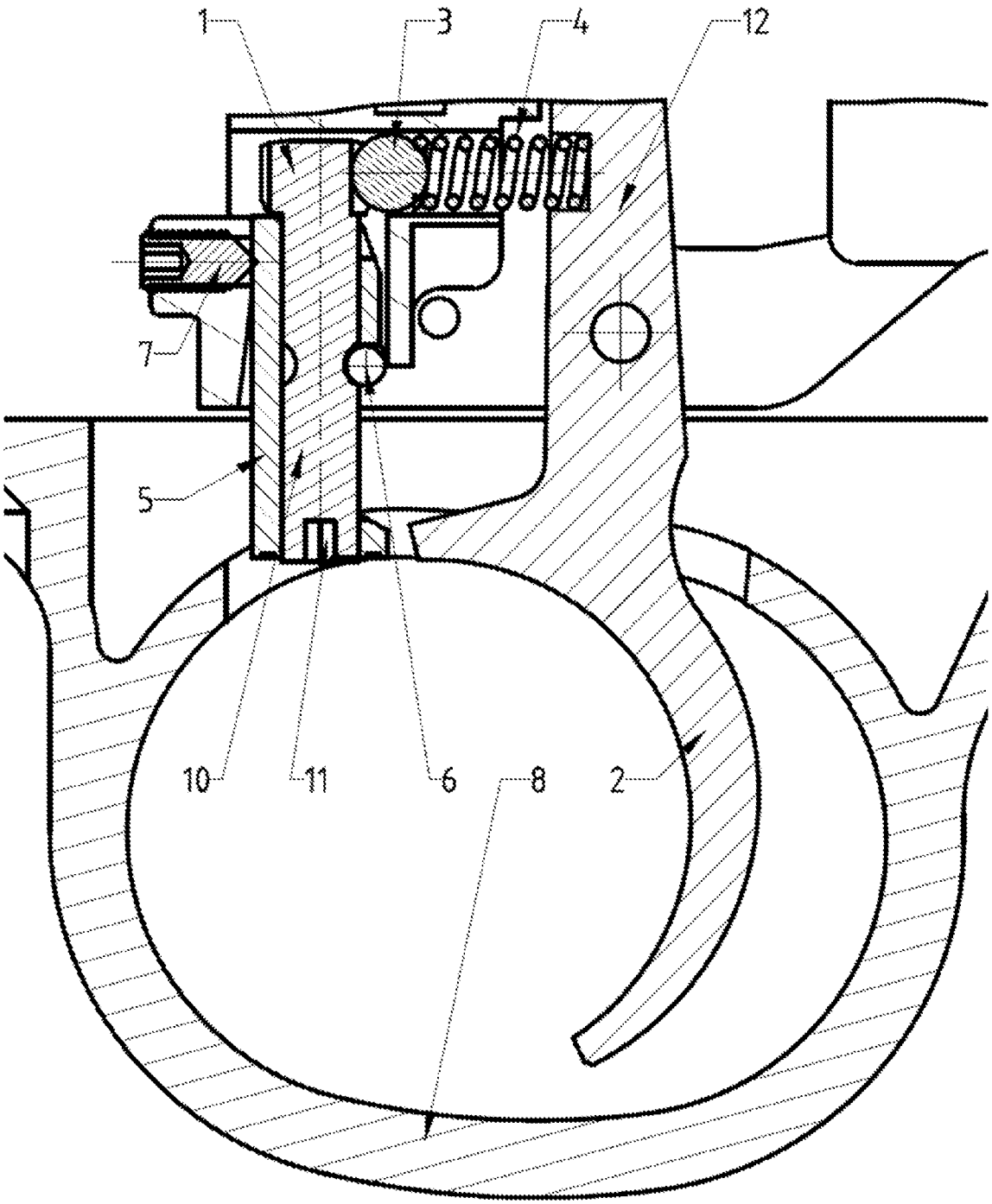

FIGS. 1 to 4 show the first embodiment example of the trigger resistance setting mechanism in a repeating rifle. In this embodiment, the trigger device consists of one class 1 lever 12 whose one arm is directly formed by the trigger 2 while the trigger 2 resistance spring 4 bears on the other arm.

At the end averted from the trigger 2, the spring 4 is equipped with a bearing element 3, in the example shown with a ball that bears on a cam 1.

Figure 3:
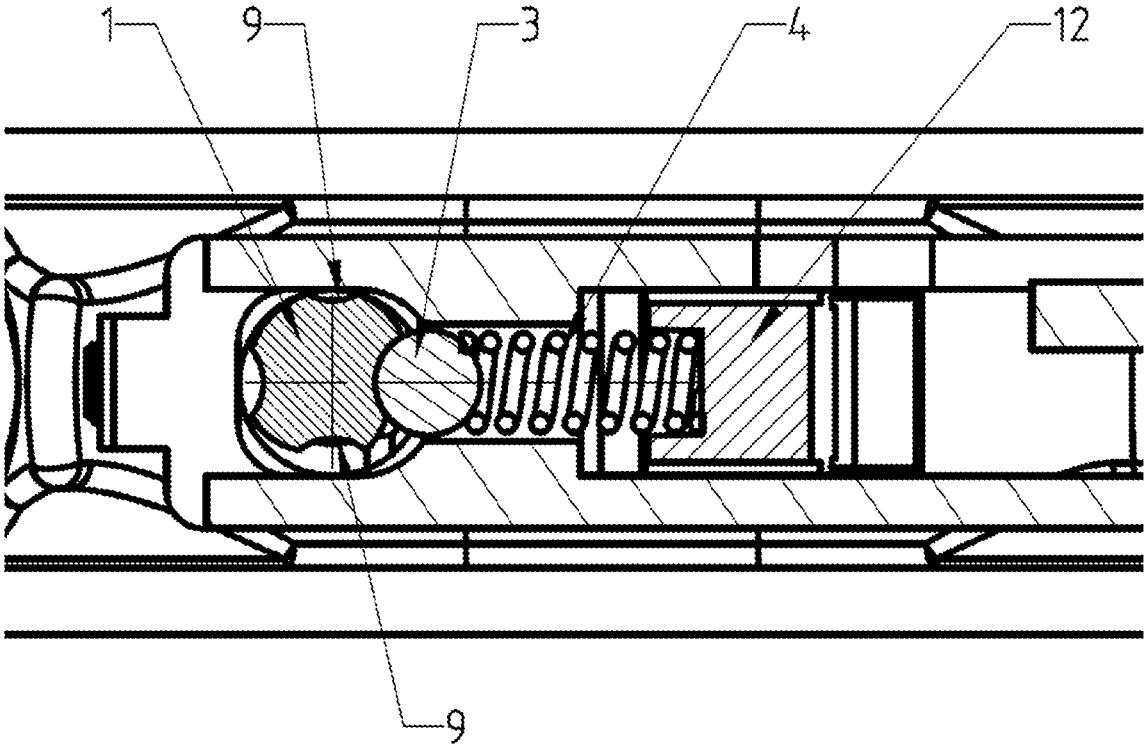

The cam 1 has four recesses 9 arranged along its perimeter with a variable depth for engagement of the bearing element 3 (see FIG. 3). Each recess 9 has a different depth, which provides four different values of trigger resistance 2.

The cam 1 is arranged on a shaft 10 that is seated in a bushing 5 in a rotary way. The bushing 5 is mounted in the firearm frame in a swiveling way on a transversal pin 6, which makes the cam 1 adjustable in the spring 4 axis direction by tilting (see FIGS. 1 and 2).

At the side averted from the spring 4, a setscrew 7 bear on the bushing 5 to readjust the bushing 5 with the cam 1 in the spring 4 axis direction. By turning of the setscrew 7, the bushing 5 with the cam 1 is tilted in the spring 4 axis direction. But this is only used to compensate production tolerances of all parts of the mechanism. This compensation is only implemented once, during the assembly of the firearm, or during its repair.

Figure 4:
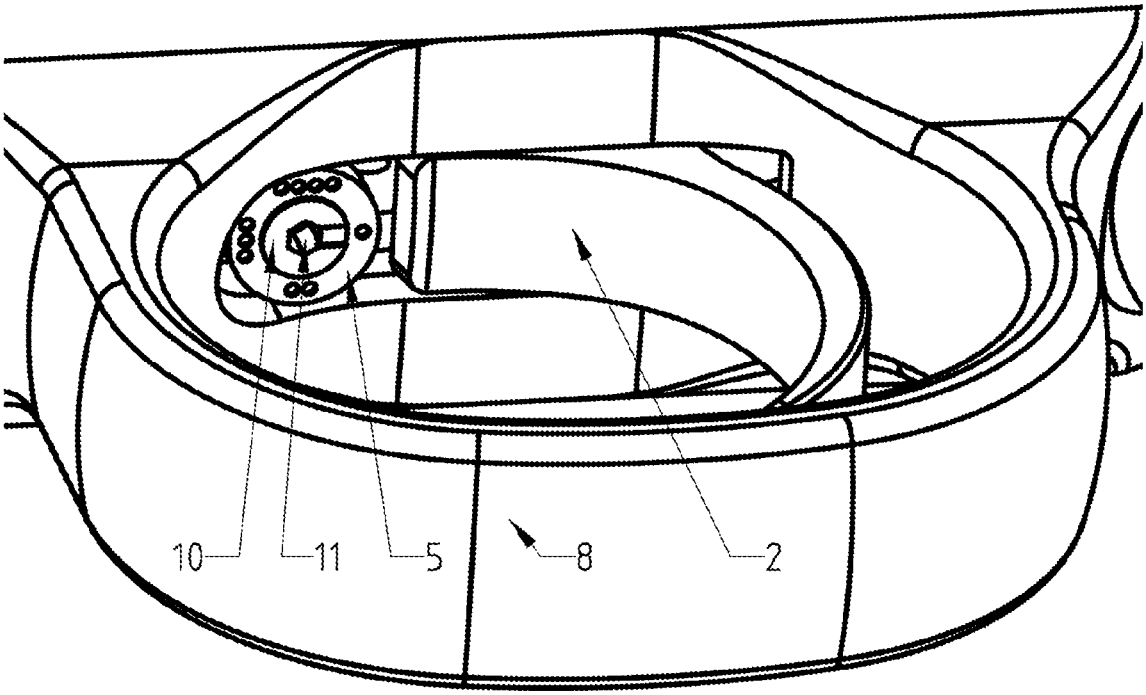

At its end averted from the cam 1, the shaft 10 is freely accessible through an opening in the firearm frame and at this end it is fitted with a shaped opening 11 for engagement of a setting tool (see FIG. 4) that can be used to rotate the shaft 10, a consequently the cam 1. In the embodiment example shown, the setting tool is a hex-wrench. FIG. 4 also shows pictograms indicating four positions of the cam 1 representing four different trigger resistance values that can be set in this embodiment.

The said first embodiment example of the trigger resistance setting mechanism works in such a way that a hex-wrench is inserted into the shaped opening 11 for engagement of the setting tool (see FIG. 4) and the hex-wrench can be used to rotate the shaft 10, and consequently the cam 1, which is fixed to the shaft 10. The ball forming the bearing element 3 gradually engages four recesses 9 with different depths (see FIGS. 1 and 3) on the working surface of the cam 1. Depending on the depth of the selected recess 9, the bearing element 3 compresses the spring 4 more or less, setting the required resistance of the trigger 2.

The currently adjusted trigger 2 resistance value can be verified any time by visually checking the end of the shaft 10 indicating through the opening in the firearm frame which of the pictograms representing a particular trigger 2 resistance value is selected (see FIG. 4).

Figure 5:
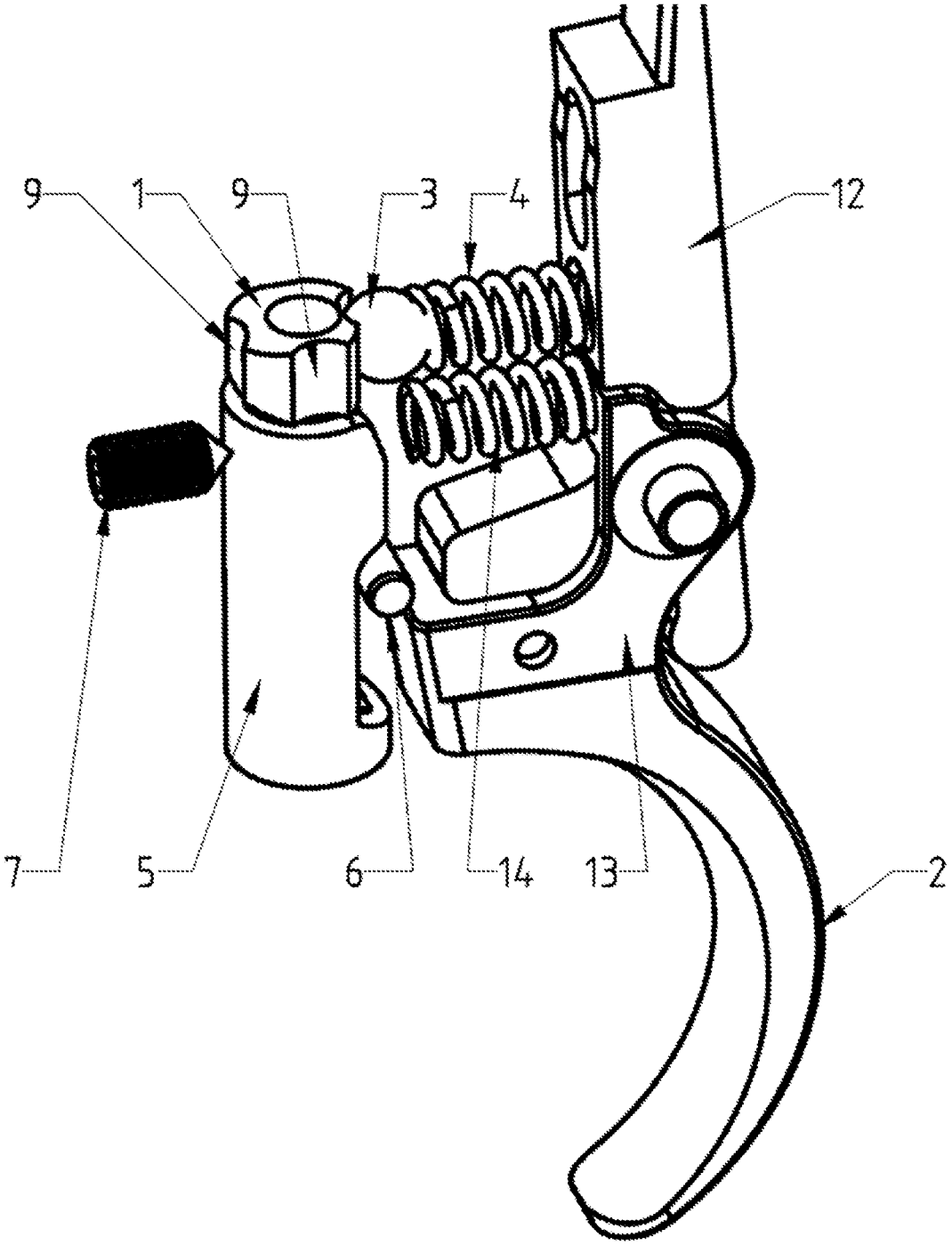

The second embodiment example of the trigger resistance setting mechanism in a repeating rifle is shown in FIG. 5. In this embodiment, the trigger device consists of a pair of mutually cooperating class 1 levers 12, 13. The cooperating class 1 lever 13 terminated directly by the trigger 2 bears on one arm of the class 1 lever 12 while the trigger 2 resistance spring 4 bears on the other arm of the class 1 lever 12.

In addition, the cooperating class 1 lever 13 is fitted with an auxiliary spring 14 bearing on the firearm frame, which is not shown here. Thus, this embodiment represents a double-resistance trigger.

After pressing of the trigger 2 created on the cooperating class 1 lever 13, the resistance of the auxiliary spring 14 is overcome first and the cooperating class 1 lever 13 readjusts the class 1 lever 12. Then, the other functions of this embodiment are the same as in the first embodiment example described above where the trigger device does not have a cooperating class 1 lever 13 and the trigger 2 directly forms one of the ends of the class 1 lever 12.

Skilled persons will find it obvious that the object of the invention can also be implemented with other embodiments than described and shown in the attached drawings.

E.g. the cam 1 can have, instead of several recesses 9, a continuously changing working surface providing an infinite number of trigger resistance setting positions, but such a setting will only be approximate.

The rotation axis of the cam 1 can be inclined in any way.

The correction of production tolerances, which is designed with the use of the setscrew 7 that acts upon the bushing 5 seated in the firearm frame in a swiveling way on the transversal pin 6 in the described embodiment, can be e.g. designed using sliding mounting of the bushing 5.

The entire trigger resistance setting mechanism, especially the trigger 2 resistance spring 4 and the cam 1, do not have to be situated in front of the trigger 2 in the shooting direction, but e.g. behind the trigger 2 in the shooting direction.

A skilled person can suggest a number of particular embodiments that will fall within the scope of the invention.

LIST OF REFERENCE SIGNS

1 cam
2 trigger
3 bearing element
4 spring
5 bushing
6 pin
7 setscrew
8 trigger guard
9 recess
10 shaft
11 shaped opening
12 class 1 lever
13 cooperating class 1 lever
14 auxiliary spring

The invention claimed is:

1. A trigger resistance mechanism comprising a trigger device, containing at least one class 1 lever (12) whose one arm is adapted to be controlled by the trigger (2) while a trigger (2) resistance spring (4) bears on the other arm, wherein the spring (4) is fitted, at the end averted from the trigger (2), with a bearing element (3) that bears on a cam (1) that is seated in the firearm frame in a rotary way.

2. The mechanism according to claim 1, wherein the cam (1) has recesses (9) arranged along its perimeter that have different depths for engagement of the bearing element (3).

3. The mechanism according to claim 2, wherein the cam (1) is arranged on a shaft (10) wherein the shaft (10) is seated in a rotary way in a bushing (5) that is mounted in the firearm frame.

4. The mechanism according to claim 3, wherein the bushing (5) is mounted in the firearm frame adjustably in the spring (4) axis direction.

5. The mechanism according to claim 4, wherein the bushing (5) is mounted in the firearm frame in a swiveling way on a transversal pin (6) so that the cam (1) is adjustable in the spring (4) axis direction.

6. The mechanism according to claim 3, wherein the shaft (10) is freely accessible in the firearm frame at the end that is averted from the cam (1) and is fitted with a shaped opening (11) for engagement of a setting tool.

7. The mechanism according to claim 3, wherein a setscrew (7) bears on the bushing (5) to readjust the bushing (5) with the cam (1) in the spring (4) axis direction.

* * * * *